United States Patent [19]

Searfoss, Jr.

[11] 4,029,135

[45] June 14, 1977

[54] NAIL DRIVING TOOL

[76] Inventor: George H. Searfoss, Jr., 14121 Franklin St., Woodbridge, Va. 22191

[22] Filed: Oct. 24, 1975

[21] Appl. No.: 625,872

[52] U.S. Cl. ..... 145/46
[51] Int. Cl.[2] ..... B25C 3/00
[58] Field of Search ..... 145/46; 81/52.35, 52.3

[56] References Cited

UNITED STATES PATENTS

| | | | |
|---|---|---|---|
| 1,850,239 | 3/1932 | McCarthy | 81/52.3 |
| 2,780,811 | 2/1957 | Rodin | 145/46 |
| 2,849,714 | 9/1958 | Allen | 145/46 |
| 3,228,269 | 1/1966 | Heyer | 145/46 |

*Primary Examiner*—James L. Jones, Jr.

*Attorney, Agent, or Firm*—Shlesinger, Arkwright, Garvey & Dinsmore

[57] ABSTRACT

A nail driving tool comprising an elongated driving member including a rear portion having a striking surface and a forward portion having a longitudinal slot extending to the forward end thereof, an axial recess contiguous to the slot and a transverse notch forwardly of the recess and contiguous to both the recess and the slot. The recess is wider than the slot and includes a nail impacting surface which is generally collinear with the bottom of the slot and the striking surface along a line coincident with or parallel to the longitudinal axis of the member. An axial recess is provided in the forward end of the member and is dimensioned to receive the head of a nail whereby the nail may be driven flush with the surface.

16 Claims, 15 Drawing Figures

NAIL DRIVING TOOL

BACKGROUND OF THE INVENTION

The present invention relates to a tool for holding and driving a nail in inaccessible places and in places where a hammer cannot easily be swung.

In many situations confronting the home owner or carpenter, it is necessary to drive a nail in relatively inaccessible places such as in a corner formed by two adjacent surfaces or in deeply recessed areas. In such situations, it is often extremely difficult to start the nail because there is insufficient space to accommodate the hand and fingers of the person holding the nail. Furthermore, the limitations of space may make it impossible to swing the hammer more than several inches or with any force thereby making driving of the nail quite difficult. When attempting to start or drive a nail under these conditions, bent or misplaced nails are quite common, not to speak of possible injury to one's fingers or thumb.

For inexperienced or unskilled persons, driving a nail in a relatively flat surface free of obstructions can also be a problem when starting the nail due to missing the nail head with the hammer and striking the fingers or thumb. Another difficulty often encountered by the inexperienced is that of bending the nail prior to its being completely driven into the surface of the wood.

In finish carpentry where the nails cannot be visible, they must be set beneath the surface of the wood and then covered with putty or plastic wood. This requires the use of a separate tool, one end of which is placed against the head of the driven nail while the other end is struck with a hammer thereby driving the head of the nail into the wood without marring the surface.

The prior art includes a number of nail drivers including an elongated member having a slot in its forward end for receiving the head and shank of a nail. In several instances, the nail is held within the slot by means of resilient detents such as a spring loaded ball latch or a wire clip. The use of such detent mechanisms is undesirable because the nail is not positively held against lateral movement during driving thereby resulting in bent nails or nails which are not accurately located. A further difficulty resides in the fact that the detent must be overcome in removing the tool from the partially driven nail. This often causes the nail to be pulled loose or misaligned. A further class of prior art nail holders comprise a hammerhead provided with means for engaging both the head and shank of the nail which is then started by swinging the hammer against the surface of the wood. Although a device of this character may protect the fingers of the user, it is obviously not useful for starting and driving nails in inaccessible places or where it is impossible to swing the hammer through its full arc.

OBJECTS OF THE INVENTION

It is, therefore, an object of this invention to provide a nail driver which is useful for starting and driving nails into relatively inaccessible places such as corners or recessed locations or in situations where a hammer cannot be swung through its full arc.

Another object of this invention is to provide a nail driving tool which is useful for starting nails in any surface and eliminates the necessity for the nail to be held by the fingers when starting it thereby decreasing the chances of the person's hand being struck by the hammer.

A further object of this invention is to provide a nail driving tool which is adapted to start, drive and set nails over a given range of sizes and types.

Another object of this invention is to provide a nail driving tool which enables positive holding of the nail in a straight or angular position by means of applying fulcrum presure in any direction by turning the tool to the most convenient position and holding the nail firmly in contact with the nailing surface during driving.

Yet another object of this invention is to provide a nail driving tool whereby the nail may be securely held during driving so that lateral movement, bending and misplacement is prevented.

A still further object of this invention is to provide a nail driving tool which may be easily removed from the partially driven nail and then placed against the nail for completing the driving and setting of the nail with minimal manipulation of the tool.

Another object of this invention is to provide a nail driving tool which is magnetized to enable the nail to be held while the holder is moved into position for driving.

A still further object of this invention is to provide a nail driving tool which includes a recess in its forward surface so that the tool will not slip off the nail head during driving and setting thereby marring the surface.

Yet another object of this invention is to provide a nail driving tool to which one or more extensions may be added to enable the reaching of deeply recessed places.

A further object of this invention is to provide a nail driving tool which has no moving parts, is durable, and is capable of being manufactured relatively inexpensively.

These and other objects and advantages of the invention will be apparent from the detailed description of the preferred embodiment.

SUMMARY OF THE INVENTION

A nail driving tool comprising: an elongated driving member including a rear end portion having a striking surface substantially parallel to the longitudinal axis of the member, a transverse notch in the member near the forward end thereof, an axial recess in the member rearwardly of the notch and contiguous thereto, the recess and notch being dimensioned to receive the head of a nail, and the recess including a nail impacting surface parallel to the striking surface, a longitudinal slot in the forward portion of the member contiguous to the notch and extending to the forward end of the member, the notch being narrower than the recess and dimensioned to receive the shank of a nail, a nail fulcrum within the slot forwardly of the notch and being substantially collinear with the nail impacting surface and striking surface.

DETAILED DESCRIPTION OF THE INVENTION

Figure 1:
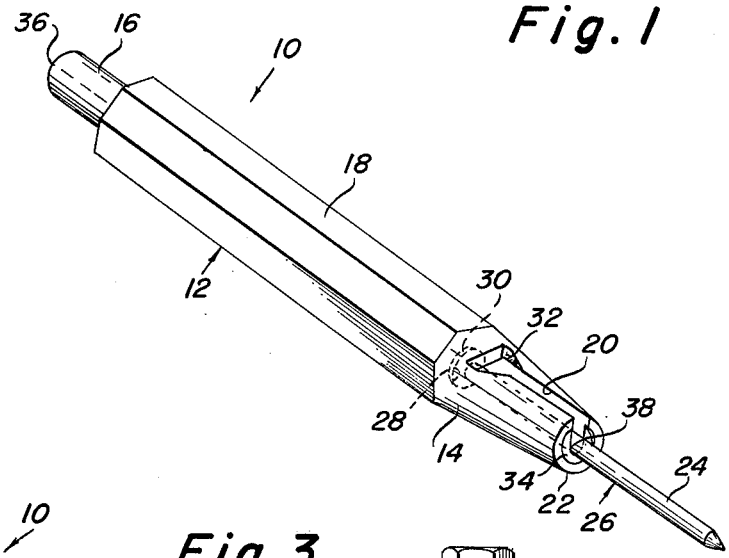
FIG. 1 is a perspective view of the nail driving tool of the present invention with a common nail inserted therein.
Figure 2:
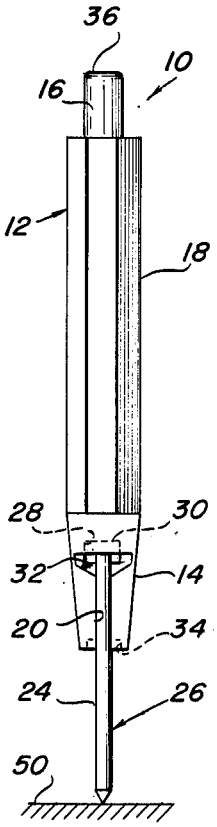
FIG. 2 is a front elevational view of the nail driving tool and nail of FIG. 1 with the nail in position to be started.

Referring to FIGS. 1–6, the nail holder and driver 10 of the present invention is illustrated. It comprises an elongated hexagonal body 12 having a tapered forward portion 14, a cylindrical rear portion 16 and a hexagonal center portion 18. The forward portion 14 and rear 16 may be formed by turning down a piece of hexagonal bar stock on a lathe. The center portion 18 is preferably hexagonal so that it may be easily gripped by the user and may be attached to an appropriate extension as will be described in detail below.

The forward portion 14 is provided with a longitudinal slot 20 which extends from a point beyond the hexagonal center portion 18 to the end 22 and is of sufficient width and depth to receive the shank 24 of a nail 26. Communicating with slot 20 is an axial recess 28 which is preferably circular in cross section and lies along the longitudinal axis of body 12. The recess 28 is preferably larger in diameter than the width of slot 20 and dimensioned to receive the head 30 of nail 26. Although not critical, it is preferred that the recess 28 be as deep as the nail head 30 to retain it securely against movement in all lateral directions. Contiguous to slot 20 and recess 28 is a transverse notch 32 which is sufficiently wide to permit the nail head 30 to pass therethrough into recess 28.

Figure 3:
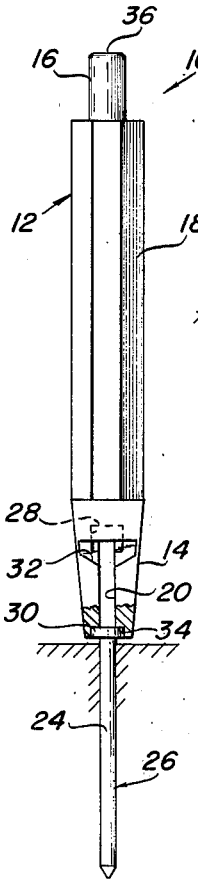
FIG. 3 is a front elevational view similar to FIG. 2 showing the partially driven nail in position to be set beneath the surface.

The forward end 22 is also provided with a circular axial recess 34 which is suitably dimensioned to receive the nail head 30 as illustrated in FIG. 3. The reduced rear portion 16, which may be of a higher hardness than center portion 18, is provided with a flat striking surface 36. In order to most effectively transmit the blow of the hammer to the nail 24, striking surface 36, the rear surface 37 of recess 28 and the rear surface of recess 34 are preferably substantially collinear along the longitudinal axis of body 12. In order to support the nail along this axis, the bottom surface 38 of slot 20 is generally parallel to the longitudinal axis and slightly displaced therefrom.

Figure 4:
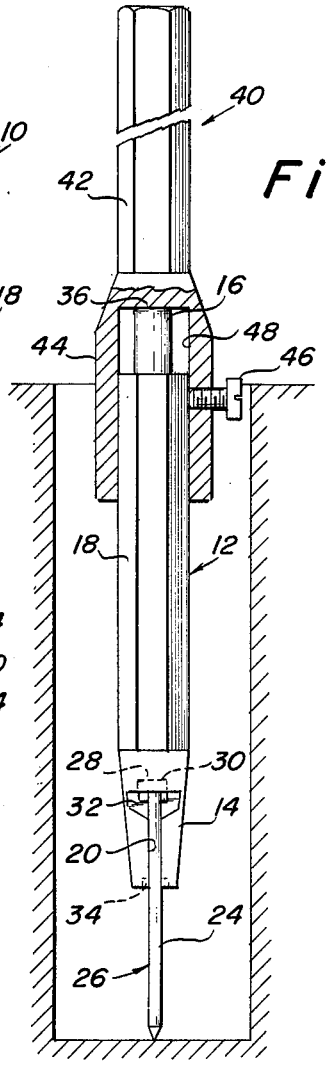
FIG. 4 is a front elevational view partially in section showing the nail driving tool of FIGS. 1–3 to which an extension has been added in order to start and drive the nail within a deeply recessed location.
Figure 5:
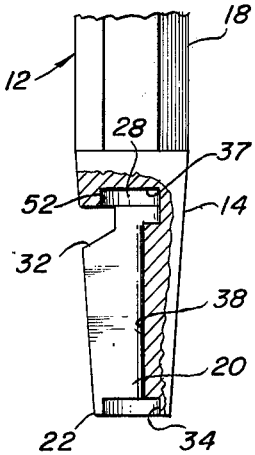
FIG. 5 is an enlarged fragmentary side elevational view of the nail driving tool illustrated in FIGS. 1–4.
Figure 6:
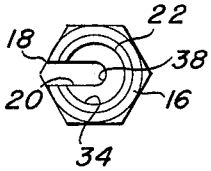
FIG. 6 is an end view of the nail driving tool illustrated in FIG. 5.
Figure 7:
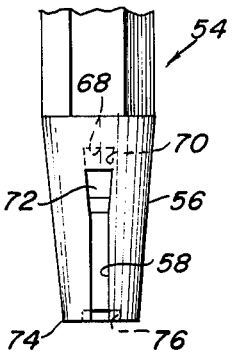
FIG. 7 is an enlarged fragmentary front elevational view of a second embodiment of the invention adapted to hold cut concrete or masonry nails.

When it is necessary to drive nails in places which are deeply set back such as illustrated in FIG. 4, an extension 40 may be added. The extension 40 comprises an elongated hexagonal body 42 which may be of a convenient length and an enlarged hollow portion 44 having hexagonal internal dimensions which correspond to the external dimensions of center portion 18 so that a close fit between body 12 and extension 40 may be achieved. In order to prevent extension 40 from slipping off during use, the portion 44 may be magnetized so that it is attracted to body 12 or may be provided with a set screw 46 which is threadedly received in portion 44 and engages one of the flattened sides of center portion 18. Since a certain amount of flanging of rear portion 16 will occur due to its being struck with a hammer, it is formed with a reduced diameter relative to center portion 18 so that there is sufficient clearance between it and the inner surfaces 48 of portion 44. By providing center portion 18 with external dimensions which are hexagonal and portion 44 of extension 40 with inner dimensions which are hexagonal, positive control of the nail during positioning and driving will be assured. It should be noted, however, that although the present embodiment has been described as having a hexagonal configuration, other configurations such as circular or square cross sections will also work effectively.

The embodiment illustrated in FIGS. 1–6, which is particularly adapted to hold and drive common nails, is held by the center portion 18 in either hand and the nail 26 is inserted by aligning the shank 24 with slot 20 and then dropping the nail head 30 through notch 32 and sliding it rearwardly into recess 28. In order to hold the nail in this position during positioning, the tool 10 may be magnetized. The device is then manipulated by the user to place the nail 26 against the surface 50 into which it will be driven and lateral force is exerted to urge the bottom surface 38 of slot 20 against the shank 24 of the nail. By moving the end of the device 22 in this direction, that portion of the bottom surface 38 of slot 20 immediately above recess 34 is urged against the shank 24 of the nail and functions as a fulcrum with the head of the nail 30 abutting against the opposite surface 52 of recess 28 and the nail point being urged in a direction out of the page as viewed in FIGS. 2, 3 and 4 against the frictional resistance of surface 50. By applying fulcrum pressure in this manner, nail 26 is positively held against movement once it is positioned against the surface 50 and may be driven partially therein by striking surface 36 with a hammer or other appropriate tool. Once the nail has been partially driven into surface 50, the lateral force may be released somewhat and the nail can continue to be driven until the forward end 22 is immediately above the surface 50. At this time, the tool 12 is withdrawn from nail 26 by reversing the movements required to insert the nail 26 therein. The forward recess 34 is then placed on the nail head 30 and the nail is continued to be driven beneath the surface 50 by again striking surface 36 with a hammer. The position of nail head 30 within recess 34 is illustrated in FIG. 3. By virtue of recess 34, the tool 10 will not slip off nail head 30 with resulting marring of the surface 50 or injury to the user should he strike his fingers or thumb.

Should it be necessary to drive the nail 26 in a particularly inaccessible or deeply recessed place, an extension 40 may be added by slipping the enlarged hollow portion 44 over rear portion 16 and part of center portion 18 and then tightening set screw 46.

Under normal conditions, it is desirable to drive the nail slightly over half way into the wood in order to prevent bending subsequent driving. For this reason, the length of tapered forward portion 14 may be increased or decreased depending upon the size of nail employed. Furthermore, although tolerances should be reasonably close to assure control of the nail during driving, a given size tool having a particular slot and notch width and recesses 28 and 34 of a particular diameter may be employed for nails over a limited range of sizes. For example, one size of tool could accommodate common nails from fourpenny to eightpenny and another size from tenpenny to fourteenpenny with additional sizes capable of accommodating nails as large as sixtypenny.

Figure 9:
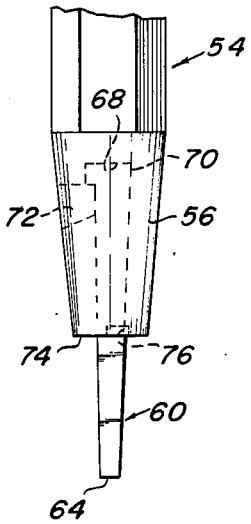
FIG. 9 is a side elevational view of the tool illustrated in FIG. 7 in which a cut masonry or concrete nail has been inserted.
Figure 10:
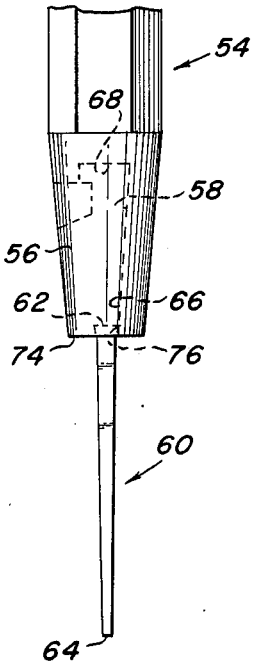
FIG. 10 is a view similar to FIG. 9 wherein the nail is in position to be set.
Figure 8:
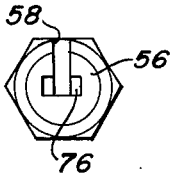
FIG. 8 is an end view of the tool illustrated in FIG. 7.

Referring now to FIGS. 7, 8, 9 and 10, a second embodiment of the invention adapted to hold and set cut concrete or masonry nails is illustrated. The tool 54 is identical to that illustrated in FIGS. 1 through 6 with the exception of the shape of the recesses and notches in the forward portion 56. In this case, the slot 58 is rectangular in cross section and preferably has square corners as opposed to the more rounded corners of slot 20 in the embodiment shown in FIGS. 1 through 6. Furthermore, to accommodate the cut nail 50 which is gradually tapered from head 62 to point 64, the bottom surface 66 of slot 58 slants slightly toward the longitudinal axis as illustrated in FIGS. 9 and 10. This permits the nail 60 to be firmly supported during driving with its point 64 lying along the longitudinal axis and collinear with the striking surface (not shown) and the back surface 68 of axial recess 70. Since the head of a cut nail tapers slightly and is somewhat larger than the shank, transverse notch 72 and recess 70 should be similarly shaped relative to the width of slot 58. In order to permit the cut nail 60 to be completely driven into the surface, the forward end 74 is provided with a rectangular recess 76 adapted to receive the nail head 62 as shown in FIG. 10. It should be noted that this recess 76 lies at right angles to slot 58.

Figure 11:
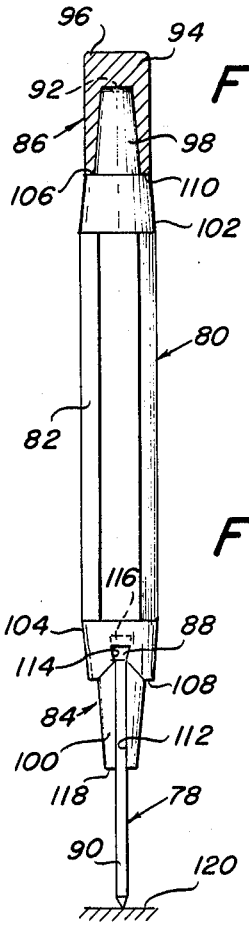
FIG. 11 is a front elevational view of a third embodiment of the invention adapted to drive finishing nails and wherein a finishing nail has been inserted.
Figure 12:
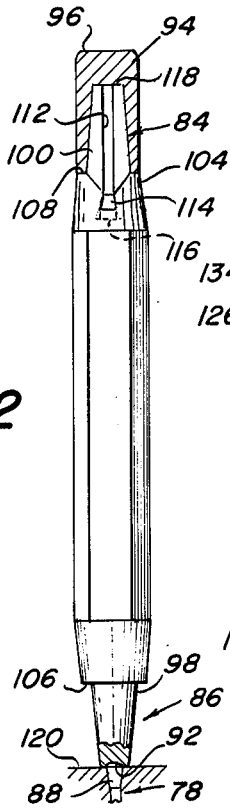
FIG. 12 is a front elevational view of the tool illustrated in FIG. 11 with the driving cap placed on the opposite end and the tool inverted to set the nail.

A further embodiment is illustrated in FIGS. 11 and 12 and is adapted to hold and drive finishing nails such as nail 78. Similarly to the embodiments previously described, the tool 80 comprises a hexagonal center portion 82, and forward and rear portions indicated generally as 84 and 86, respectively. Due to the nature of a finishing nail wherein the head 88 is only slightly larger in diameter than the shank 90, the axial recess 92 adapted to set the nail is located on the rear portion 86 rather than the forward portion 84. In order to permit the nail to be started and set, an end cap 94 made of hard steel including a striking surface 96 and adapted to fit over the tapered reduced portions 98 and 100 is provided. The portions 98 and 100 are turned down further than portions 102 and 104 thereby forming annular shoulders 106 and 108 against which the rim 110 of cap 94 abutts. This arrangement, then, permits the tool 80 to be struck with a hammer on either end without damage to the nail set recess 92 or portion 100. Similarly to the previous embodiments, the forward portion 84 is provided with a longitudinal slot 112, a transverse notch 114 and an axial recess 116.

To use the tool 80, a finishing nail is inserted in slot 112 with the head 88 passing through notch 114 and is then moved axially back into recess 116. The nail is then manipulated into position and the lateral force described previously is applied to thereby hold the nail steady against the side walls of recess 116, the fulcrum point within slot 112 at or near the tip 118 and the surface of the wood 120. The striking surface 96 is then struck with a hammer to drive the nail partially into the wood. The tool is then inverted, the cap 94 placed on portion 84, the nail set recess placed against the nail head 88 and the striking surface 96 of cap 94 is again struck with repeated blows from a hammer thereby driving the nail beneath the surface 120 as shown in FIG. 12. By magnetizing the tool 80, the nail 78 and cap 94 may be retained in position as the tool is manipulated by the user.

Figure 13:
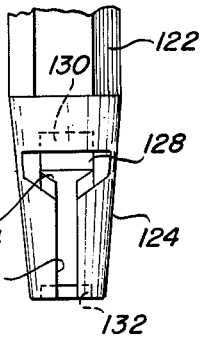
FIG. 13 is an enlarged fragmentary elevational view of a fourth embodiment of the invention adapted to hold another type of concrete masonry nail.
Figure 14:
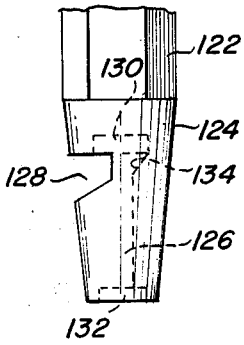
FIG. 14 is an enlarged fragmentary side elevational view of the tool illustrated in FIG. 13.
Figure 15:
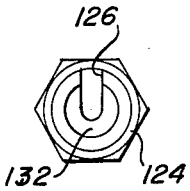
FIG. 15 is an end view of the tool illustrated in FIG. 13.

A further embodiment of the invention adapted to hold and drive masonry and concrete nails having a tapered head is illustrated in FIGS. 13, 14 and 15. It comprises a hexagonal center portion 122, a tapered forward portion 124, a longitudinal slot 126, a transverse notch 128 and axial recesses 130 and 132. The distinction between this embodiment and the embodiment shown in FIGS. 1 through 6 lies in the tapered surface 134 of slot 126. It should be noted, that in addition to concrete and masonry nails having tapered heads, a common nail similar to that shown in FIGS. 1 through 4 may be held and driven by this tool. As was the case in the other embodiments, this tool may be magnetized to hold the nail in position as it is manipulated by the user and may be provided with one or more extensions similar to that illustrated in FIG. 4.

While this invention has been described as having a preferred design, it will be understood that is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the appended claims.

What is claimed is:

1. A nail driving tool comprising:

an elongated driving member including a rear end portion having a striking surface substantially perpendicular to the longitudinal axis of said member, a transverse notch in said member near the forward end thereof, an axial recess in said member rearwardly of said notch and contiguous thereto, said recess extending rearwardly along the longitudinal axis of said member, said recess and said notch being dimensioned to receive the head of a nail, said recess including a nail impacting surface substantially parallel to said striking surface, a longitudinal slot in the forward portion of said member contiguous to said notch and extending to said forward end of said member, said slot being narrower than said recess and dimensioned to receive the shank of a nail, a nail fulcrum within said slot forwardly of said notch, said nail fulcrum, said nail impacting surface and said striking surface being substantially collinear.

2. The device of claim 1 and including an axial recess in said forward end of said member coolinear with said striking head and dimensioned to receive the head of a nail.

3. The device of claim 1 wherein said member includes a center portion and wherein the cross sectional dimensions of said rear end portion are smaller than the cross sectional dimensions of said center portion.

4. The device of claim 3 wherein said center portion is hexagonal in cross section and said rear end portion is cylindrical.

5. The device of claim 4 wherein the diameter of said rear end portion is smaller than the diagonal of said center portion.

6. The device of claim 3 and including an elongated extension member positioned over said rear end portion and detachably secured to said center portion.

7. The device of claim 6 and wherein said extension member is magnetized.

8. The device of claim 1 wherein the forward end of said tool is magnetized.

9. A nail driving tool comprising:

an elongated driving member including a rear end portion having a striking surface substantially perpendicular to the longitudinal axis of said member, a longitudinal slot in the forward portion of said member extending to the forward end thereof and being sufficiently wide to accommodate the shank of a nail, said slot having a bottom surface, an axial recess in said member contiguous to said slot and including a nail impacting surface substantially parallel to said striking surface, a transverse notch in said member forwardly of said recess and contiguous to said recess and said slot, said axial recess extending rearwardly of said notch along the longitudinal axis of said member, said recess being wider than said slot and dimensioned to receive the head of a nail, said slot bottom surface, said nail impacting surface and said striking surface being generally collinear along a line parallel to the longitudinal axis of said member.

10. The device of claim 9 and wherein said bottom surface slants toward the longitudinal axis of said member so that said slot tapers in a forward direction.

11. The device of claim 10 and including a rectangular axial recess inserted said forward end of said member collinear with the longitudinal axis of said member and wherein the long dimension of said recess extends in a direction transverse to said slot.

12. The device of claim 9 and wherein said member is magnetized.

13. The device of claim 1 and wherein:

said rear end portion comprises a rearwardly facing shoulder and a removable driving cap including a rim in abutment with said shoulder, and said striking surface comprises a surface on said cap substantially perpendicular to the longitudinal axis of said member.

14. The device of claim 13 and wherein said forward end includes a forwardly facing shoulder dimensioned similarly to said rearwardly facing shoulder.

15. The device of claim 13 and wherein said member is magnetized.

16. The apparatus of claim 13 wherein said forwardly and rearwardly facing shoulders are annular and the ends of said forward and rear portions are tapered.

* * * * *